US009085981B2

(12) United States Patent
Lee et al.

(10) Patent No.: US 9,085,981 B2
(45) Date of Patent: Jul. 21, 2015

(54) DUCTING ARRANGEMENT FOR COOLING A GAS TURBINE STRUCTURE

(71) Applicants: Ching-Pang Lee, Cincinnati, OH (US); Jay A. Morrison, Titusville, FL (US)

(72) Inventors: Ching-Pang Lee, Cincinnati, OH (US); Jay A. Morrison, Titusville, FL (US)

(73) Assignee: SIEMENS ENERGY, INC., Orlando, FL (US)

( * ) Notice: Subject to any disclaimer, the term of this patent is extended or adjusted under 35 U.S.C. 154(b) by 62 days.

(21) Appl. No.: 13/655,675

(22) Filed: Oct. 19, 2012

(65) Prior Publication Data

US 2014/0109577 A1 Apr. 24, 2014

(51) Int. Cl.

| | |
|---|---|
| ***F01D 9/06*** | (2006.01) |
| ***F23R 3/02*** | (2006.01) |
| ***F23R 3/06*** | (2006.01) |
| ***F23R 3/54*** | (2006.01) |
| ***F01D 9/02*** | (2006.01) |
| ***F23R 3/00*** | (2006.01) |

(52) U.S. Cl.

CPC ..... *F01D 9/023* (2013.01); *F23R 3/002* (2013.01); *F05D 2260/20* (2013.01); *F05D 2260/202* (2013.01); *F23R 3/06* (2013.01); *F23R 3/54* (2013.01); *F23R 2900/03045* (2013.01)

(58) Field of Classification Search

CPC ..... F23R 3/002; F23R 3/06; F23R 3/54; F23R 2900/03045; F01D 9/023; F05D 2260/20; F05D 2260/202

USPC ..... 60/755, 752, 757, 758

See application file for complete search history.

(56) References Cited

U.S. PATENT DOCUMENTS

| | | | | |
|---|---|---|---|---|
| 2,447,482 | A | | 4/1945 | Arnold |
| 3,349,558 | A | | 10/1967 | Smith |
| 3,910,039 | A | | 10/1975 | Fortini |
| 4,195,474 | A | | 4/1980 | Bintz et al. |
| 4,236,378 | A | * | 12/1980 | Vogt ..... 60/757 |
| 4,622,821 | A | | 11/1986 | Madden |
| 4,872,312 | A | | 10/1989 | Iizuka et al. |
| 5,329,773 | A | | 7/1994 | Myers et al. |
| 5,363,654 | A | | 11/1994 | Lee |
| 5,467,815 | A | | 11/1995 | Haumann et al. |
| 5,802,841 | A | | 9/1998 | Maeda |
| 6,018,950 | A | | 2/2000 | Moeller |
| 6,134,877 | A | | 10/2000 | Alkabie |

(Continued)

FOREIGN PATENT DOCUMENTS

JP 2003286863 A * 10/2003 ..... F02C 7/18

OTHER PUBLICATIONS

English Machine Translation of JP 2003286863 A, provided by the Japan Patent Office Advanced Industrial Property Network.*

*Primary Examiner* — Ehud Gartenberg
*Assistant Examiner* — Jason H Duger

(57) ABSTRACT

A ducting arrangement (10) for a can annular gas turbine engine, including: a duct (12, 14) disposed between a combustor (16) and a first row of turbine blades and defining a hot gas path (30) therein, the duct (12, 14) having raised geometric features (54) incorporated into an outer surface (80); and a flow sleeve (72) defining a cooling flow path (84) between an inner surface (78) of the flow sleeve (72) and the duct outer surface (80). After a cooling fluid (86) traverses a relatively upstream raised geometric feature (90), the inner surface (78) of the flow sleeve (72) is effective to direct the cooling fluid (86) toward a landing (94) separating the relatively upstream raised geometric feature (90) from a relatively downstream raised geometric feature (94).

11 Claims, 3 Drawing Sheets

(56) References Cited

U.S. PATENT DOCUMENTS

| | | | |
|---|---|---|---|
| 6,173,561 | B1 | 1/2001 | Sato et al. |
| 6,681,578 | B1 | 1/2004 | Bunker |
| 6,925,808 | B2 | 8/2005 | Tiemann |
| 7,137,241 | B2 | 11/2006 | Martling et al. |
| 7,219,498 | B2 | 5/2007 | Hadder |
| 7,310,938 | B2 | 12/2007 | Marcum et al. |
| 7,373,778 | B2 | 5/2008 | Bunker et al. |
| 7,386,980 | B2 | 6/2008 | Green et al. |
| 7,757,492 | B2 | 7/2010 | Intile et al. |
| 8,015,817 | B2 | 9/2011 | Charron et al. |
| 8,033,119 | B2 * | 10/2011 | Liang ..... 60/806 |
| 2010/0170259 | A1 | 7/2010 | Huffman |
| 2010/0316492 | A1 | 12/2010 | Charron et al. |
| 2011/0110761 | A1 | 5/2011 | Haehnle et al. |
| 2011/0203282 | A1 | 8/2011 | Charron et al. |
| 2011/0232299 | A1 | 9/2011 | Stryapunin et al. |
| 2012/0121408 | A1 | 5/2012 | Lee et al. |

* cited by examiner

DUCTING ARRANGEMENT FOR COOLING A GAS TURBINE STRUCTURE

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

The invention relates to cooling of hot gas path ducting structures. In particular the invention relates to regenerative cooling of an irregular outer surface of the ducting structure.

BACKGROUND OF THE INVENTION

Conventional gas turbine engines with can annular combustors have transition ducts that receive hot gases from the combustor and direct them to a first row of turbine vanes. Upon entering the first row of turbine vanes the hot gases are accelerated from approximately 0.2 mach to approximately 0.8 mach, which is an appropriate speed for delivery onto a first row of turbine blades. The transition duct is disposed inside a plenum that receives compressed air from a compressor and delivers it to an inlet of the combustor. The transition duct separates the compressed air in the plenum from the combustion gases in the transition duct. The compressed air in the plenum is moving more slowly than the hot gases and as a result there is a static pressure difference across the transition duct that produces mechanical forces that the transition duct must withstand. Conventional transition ducts of simple tubular design have been able to withstand these relatively mild mechanical forces while remaining thin enough to permit necessary cooling.

The necessary cooling may be effected in many ways, one of which includes placing a flow sleeve around the transition duct. This creates a flow path between the two through which a cooling fluid may flow. This cools the outer surface of the transition ducts enough to ensure long service life. Film cooling holes may be disposed through the transition duct which will permit a film of cooling air to develop between an inner surface of the transition duct and the hot gases, which will also improve the service life of the transition duct.

Certain emerging technology gas turbine engine combustor system designs have a new ducting arrangement that receives a flow of hot gases from each combustor and delivers each flow along a straight flow path directly onto the first row of turbine blades. Various embodiments may unite the discrete hot gas flows in a common chamber immediately upstream of the first row of turbine blades. In these new ducting arrangements the traditional first row of turbine vanes is dispensed with. The role of accelerating the hot gases from 0.2 mach to 0.8 mach has been transferred from the traditional first row of turbine vanes to the ducting structure itself. One example of such an emerging technology combustor is disclosed in U.S. Patent Application Publication Number 2011/0203282 to Charron et al. and is incorporated herein by reference.

The new ducting structure must withstand significantly greater mechanical forces induced by the static pressure difference. The compressed air in the plenum is traveling at approximately the same speed as in the conventional gas turbine engines, but the hot gases traveling through the ducting arrangement are traveling at speeds approaching approximately 0.8 mach, which is nearly 4 times faster than the speed of the hot gases within the traditional transition ducts. The static pressure difference created by the greater difference in speed of the compressed air in the plenum (outside the ducting arrangement) and the hot gases in the ducting arrangement is therefore much greater. As a result, the new ducting arrangement must withstand much greater mechanical forces induced by the greater difference in static pressure.

Stronger designs that are still thin enough to permit sufficient cooling are being considered to enable the ducting arrangement to withstand the greater mechanical forces. Compatible cooling arrangements are needed to accommodate the stronger designs, and thus there is room for improvement in the art.

BRIEF DESCRIPTION OF THE DRAWINGS

The invention is explained in the following description in view of the drawings that show.

DETAILED DESCRIPTION OF THE INVENTION

Certain emerging technology ducting arrangements provide structural strength sufficient to overcome the mechanical forces generated by the greater pressure difference by using elongated features formed in an outer surface of the ducting arrangement such as raised ribs, which are separated by lands. These raised ribs incur the mechanical forces while allowing a duct wall to be thin enough to permit adequate cooling. These raised ribs may have a full, annular shape resembling an integral ring, and in such cases the mechanical forces may be taken by the rings as hoop force. Although these raised ribs may resolve the structural problem, the present inventors have recognized that they may further create a cooling problem unrelated to the thickness. In particular, in certain embodiments where a flow sleeve may be utilized, when the raised ribs are oriented traverse to a flow of cooling fluid in the cooling fluid pathway, the raised ribs may inhibit the flow to the point where it is less effective at cooling the outer surface. In particular, the ribs may slow a layer of the flow of cooling fluid closest to the ribs, thereby heating the slower flow, which reduces the cooling ability of the slow layer. A remainder of the flow may continue to flow at a faster rate, but may be insulated from the hot duct wall, and thus the cooling potential of the entire flow of cooling air may not be realized.

The present inventors have developed an innovative cooling arrangement that addresses ducting arrangements having such raised ribs, and which can be used with any raised geometric features. The cooling arrangement creates a cooling fluid path between the duct wall and a redesigned flow sleeve. The redesigned flow sleeve is positioned similar to conventional flow sleeves, but the redesigned flow sleeve includes a geometric pattern that directs the flow of cooling air toward the lands between raised ribs (or other raised geometric features). This forces the cooler and faster moving air on the outer perimeter of the cooling fluid path (away from the duct wall) toward the inner perimeter, which is defined by an outer wall of the duct which has the raised ribs therein. When directed toward the duct wall by the flow sleeve the direction of the directed flow is characterized by an impingement vector such that the flow impacts the duct wall surface.

The flow sleeve geometric pattern may form a pattern that loosely mirrors the outer surface of the duct outer wall, and therefore may undulate. This may create a cooling fluid path that undulates along a direction of flow of the cooling fluid therein. This redesigned flow sleeve therefore makes greater use of the cooling potential present in the flow of cooling air.

Figure 1:
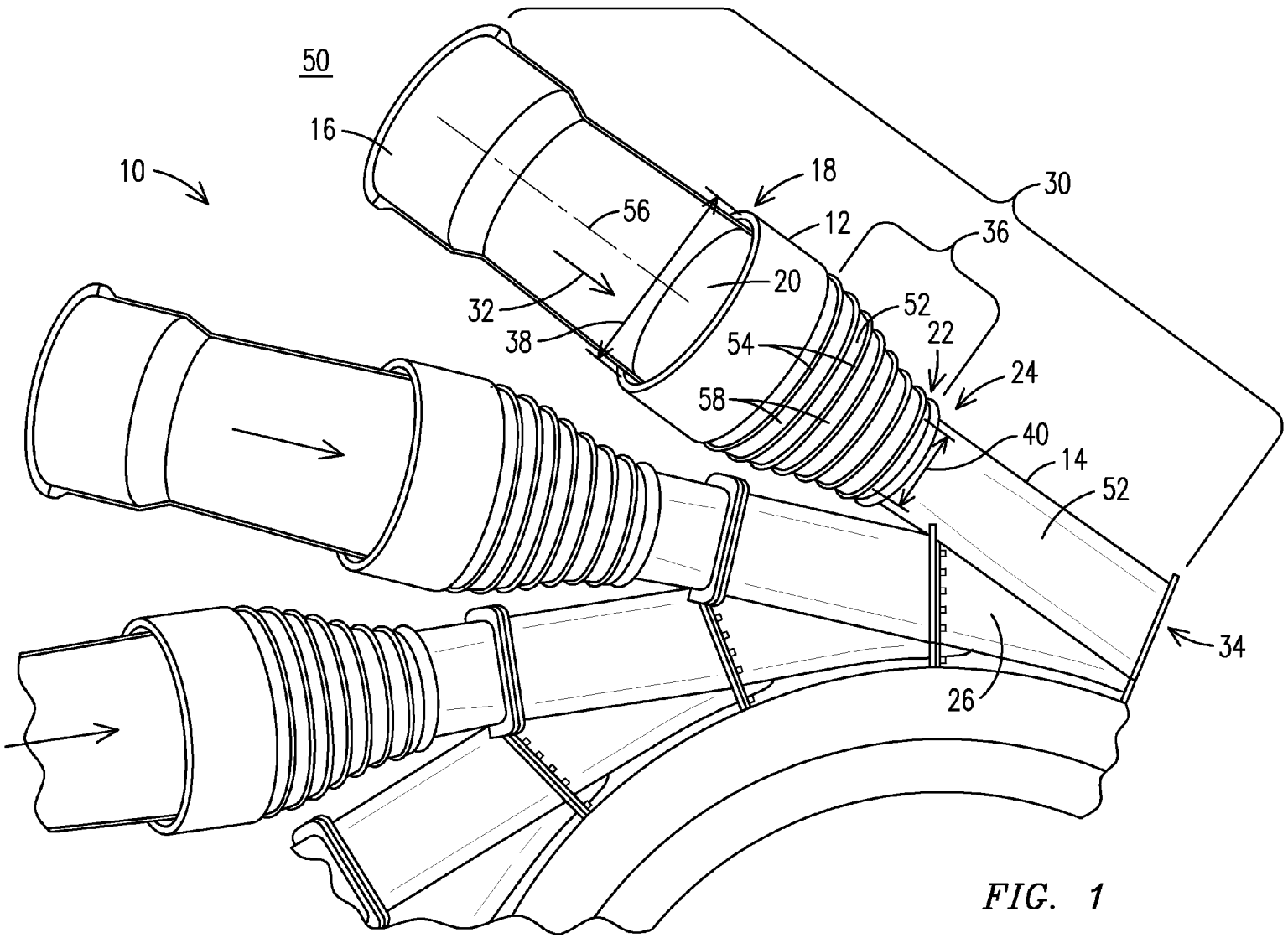
FIG. 1 shows a portion of a ducting arrangement of an emerging combustion system.

FIG. 1 shows a portion of a ducting arrangement 10. The embodiment of the ducting arrangement 10 shown includes one cone 12 and one integrated exit piece (IEP) 14 for each combustor can 16. An upstream end 18 of each cone 12 is secured to an outlet end 20 of a respective combustor can 16. A downstream end 22 of each cone 12 is secured to an upstream end 24 of a respective IEP 14. When assembled, adjacent IEP's 14 unite to form an annular chamber 26 which, when installed in the gas turbine engine (not shown), is disposed immediately upstream of a first row of turbine blades (not shown).

The ducting arrangement 10 creates a plurality of flow paths 30, each from a respective combustor 16 to an outlet end 34 of a respective IEP 14. In each flow path 30 combustion gases 32 from a combustor can 16 flow into a respective cone 12. The cone 12 includes a geometric feature 36 which accelerates the combustion gases 32 from approximately 0.2 mach when entering the cone 12 to approximately 0.8 mach. In the embodiment shown the geometric feature 36 takes the shape of a necking-down, from an inlet diameter 38 to a smaller outlet diameter 40. Reducing a cross sectional area of the flow path 30 causes the combustion gases 32 to accelerate to the desired speed. The combustion gases 32 exit the downstream end 22 of the respective cone 12 and enter the upstream end 24 of the respective IEP 14. Within the upstream end 24 of the IEP 14 each flow path 30 is discrete and entirely bound by the IEP 14. As the combustion gases 32 traverse the IEP 14 the flow paths 30 transition to being less bounded, to the point where, once in the annular chamber 26, the flow paths 30 are no longer discrete and are bounded only by the annular chamber 26, which is common to all flows 30.

The ducting arrangement 10 is disposed in a compressed air plenum 50. Compressed air in the plenum 50 is moving at a relatively slow speed with respect to the combustion gases 32. Consequently, there exists a static pressure difference across any duct wall 52 disposed in the plenum 50 that defines a flow path 30 for the combustion gases 32 which are moving at a much faster speed. Since both the cone 12 and the IEP 14 are disposed in the plenum 50 and conduct combustion gases 32, both must be designed to be structurally sufficient to overcome the mechanical forces associated with the static pressure difference, yet both must be thin enough to permit adequate cooling. Consequently, where used herein, a duct wall means any wall disposed in the plenum 50 and which conducts combustion gases 32. In the embodiment shown, the selected design incorporates raised geometric features 54 which take the shape of raised ribs which are elongated circumferentially with respect to a cone longitudinal axis 56. In between each set of adjacent raised geometric features 54 is a landing 58 that separates the raised geometric features 54. Although not shown in this embodiment, the raised geometric features 54 may be present on the IEP 14, or on any component of any other embodiment of the ducting arrangement 10.

Figure 2:
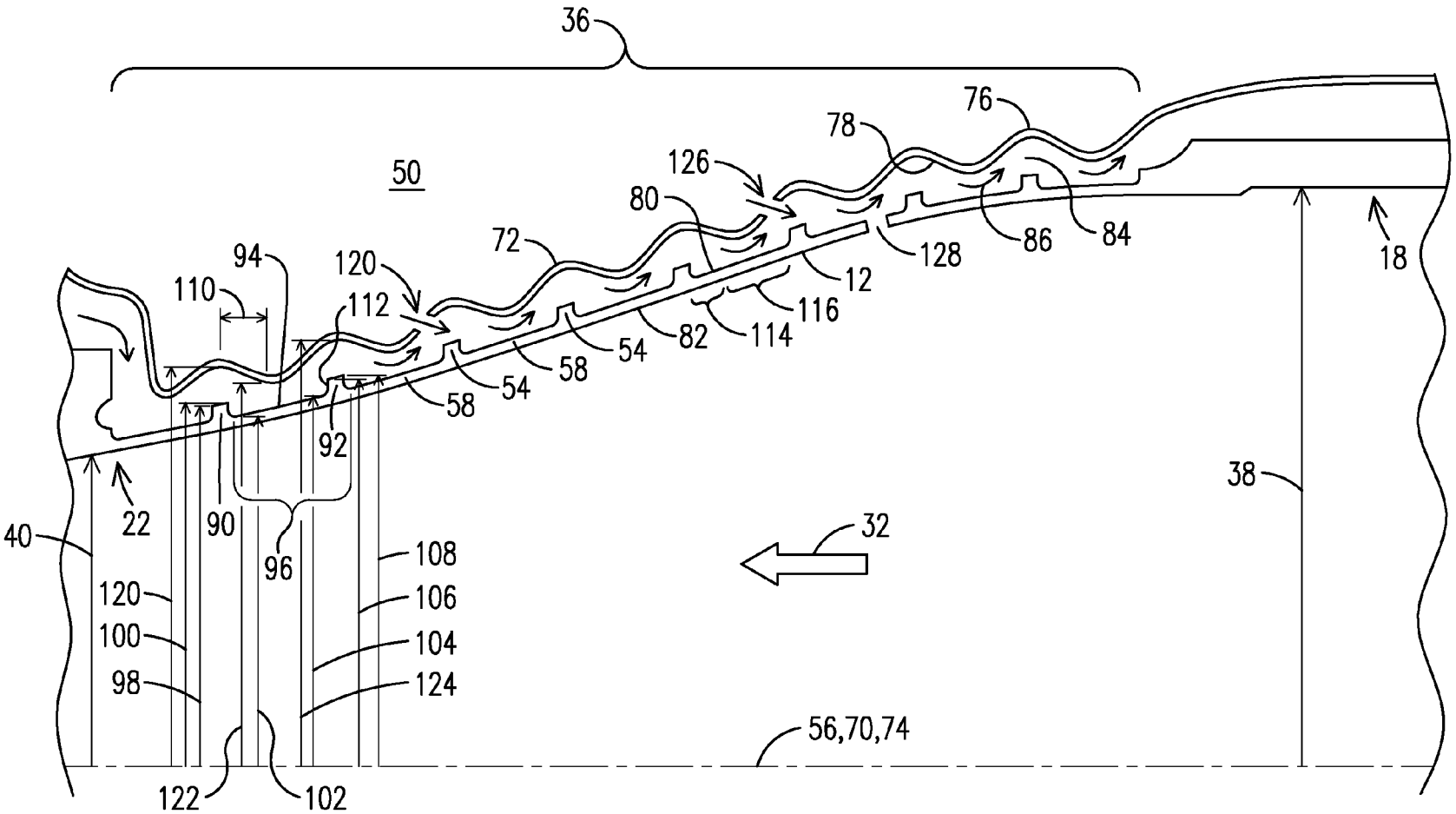
FIG. 2 shows a longitudinal cross section of an exemplary embodiment of the flow sleeve.

FIG. 2 is a schematic representation of a partial longitudinal cross section of the cone 12 disposed about the cone longitudinal axis 56 in the plenum 50. Adjacent raised geometric features 54 are separated by landings 58, and combustion gas 32 flows in the direction of travel indicated. An inner diameter of the cone 12 transitions from the inlet diameter 38 to the smaller outlet diameter 40, and this defines the geometric feature 36 which accelerates the combustion gases 32. Within the cone 12 a central axis 70 of the flow of combustion gases 32 is coincident with the cone longitudinal axis 56. A flow sleeve 72 is disposed around the cone 12 and in the exemplary embodiment shown has a flow sleeve longitudinal axis 74 that is coincident with the cone longitudinal axis 56. The flow sleeve 72 has a flow sleeve outer surface 76 and a flow sleeve inner surface 78. The cone 12 has a cone outer surface 80 and a cone inner surface 82. The flow sleeve inner surface 78 and the cone outer surface 80, (in which the raised geometric features 54 are incorporated), define a cooling fluid path 84 there between. The cooling fluid path 84 may direct a flow of cooling fluid 86 which is used to cool the cone outer surface 80 from heat imparted to the cone 12 from hot combustion gases 32 adjacent the cone inner surface 82.

In the exemplary embodiment shown the cooling fluid path receives compressed air from the plenum 50, and the compressed air acts as the cooling fluid. The cooling fluid path 84 shown in the exemplary embodiment spans at least from the downstream end 22 of the cone 12 to the upstream end 18 of each cone 12, and the flow of cooling fluid 86 travels in a direction essentially against the direction the combustion gas 32 flows, as indicated by the arrows. As used herein, the terms "essentially" (or "substantially") means that the flow travels along the cone longitudinal axis 56 in a direction against the direction of flow of the combustion gases 32, with or without changing a radial distance from the cone longitudinal axis 56. The cooling fluid path 84 may open to an inlet of the combustor 16 such that the flow of cooling fluid 86 exiting the cooling fluid path is used in the combustion process.

While flowing the flow of cooling fluid 86 encounters a relatively upstream raised geometric feature 90, a relatively downstream raised geometric feature 92, and a landing 94 separating the two features. This may be considered one set 96 of adjacent features 92, 94. The relatively upstream raised geometric feature may define a first range of radii 98, 100 of the cone outer surface 80. The landing 94 may define a second, different range of radii 102, 104 of the cone outer surface 80. The relatively downstream raised geometric feature may define a third and unique range of radii 106, 108. Consequently, as the flow of cooling fluid 86 traverses the cone outer surface 80 it encounters a range of radii that of the cone outer surface 80 which define the cooling fluid path 84. In the exemplary embodiment shown this may cause favorable mixing, but may also cause the flow of cooling fluid 86 closest to the cone outer surface 80 to slow down relative to a speed of the flow of cooling fluid 86 less close to the cone outer surface 80. When this happens the flow of cooling fluid 86 is not entirely uniformly mixed, and as a result may not be as efficient as possible at removing the heat from the cone outer surface 80.

In the exemplary embodiment shown the inventors has therefore incorporated an undulating shape for the flow sleeve inner surface 78 along the flow sleeve longitudinal axis 74. The flow sleeve inner surface 78 undulates in response to the changing radii 98, 100, 102, 104, 106, 108 on the cone outer surface 80. For example, when the radius of the cone outer surface 80 decreases in the direction of flow of the cooling fluid 86, so will an axially proximate radius of the flow sleeve inner surface 78. This is indicated where a first flow sleeve inner diameter 120 is greater than a second flow sleeve inner diameter 122. This decrease in diameter is brought about by a relative decrease in diameter from cone outer surface first range of radii 98, 100, to the cone outer surface second range of radii 102, 104. Likewise, when the radius of the cone outer surface 80 increases in the direction of flow of the cooling fluid 86, so will an axially proximate radius of the flow sleeve inner surface 78.

This is indicated where the second flow sleeve inner diameter 122 is less than a third flow sleeve inner diameter 124. This increase in diameter is brought about by a relative increase in diameter from cone outer surface second range of radii 102, 104, to cone outer surface third range of radii 106, 108. There may be several sets of relative upstream raised geometric features 90, relatively downstream raised geometric features 92, and landings 94 there between, and the flow of cooling fluid 86 may encounter each sequentially. When the cone outer surface 80 diameter changes are somewhat abrupt and in both directions, the flow sleeve inner surface 78 may take on a somewhat corrugated appearance, where the corrugations are transverse to the direction of flow of the cooling fluid 86. This is particularly possible when the landings have a slope that increases the second range of radii 102, 104 in a direction of flow of the cooling fluid 86, but at a mild rate of increase, and where the first range of radii 98, 100 are such that the second flow sleeve inner diameter 122 is less than the first flow sleeve inner diameter 120. Further, with respect to the cone longitudinal axis 56, the first range of radii 98, 100 may not have the same axial position as the first range of radii 98, 100. Instead they may be axially proximate, which means that they are located proximate each other than they work together aerodynamically, for example to create the serpentine shaped cooling fluid path 84 like that in the exemplary embodiment shown. However other shapes are considered within the scope of the disclosure.

One benefit of having the flow sleeve inner surface 78, and optionally the flow sleeve outer surface 76, undulate in this manner, is improved cooling. In particular, in a directing region 110 of the flow sleeve inner surface 78 the flow sleeve inner surface 78 is not only defining the cooling fluid path 84, but it is actually guiding the flow of cooling fluid 86 such that collides with the cone outer surface 80. This redirection has at least two effects. A first effect is to decrease a size of a separation zone 114 (indicated generally) where the flow of cooling fluid 86 separates from the cone outer surface 80 after traversing each raised geometric feature 54. Without the redirecting effect of the directing region 110 of the flow sleeve inner surface 78, the flow of cooling fluid 86 reattaches to the cone outer surface 80 further downstream, leaving a shorter unseparated zone 116. However, with the directing region 110 of the flow sleeve inner surface 78, the flow of cooling fluid 86 is forced to reattach sooner, and this brings about a longer unseparated zone 116. Cooling is more efficient in the unseparated zone 116 than in the separation zone 114. Consequently, the directing region 110 yields an increase in an amount of the cone outer surface 80 that is actively being cooled by the flow of cooling fluid 86, and increasing the amount of surface area being cooled increases total heat transfer.

A second effect of the directing region of the flow sleeve inner surface 78 is that it brings about cooling effects similar to those seen in impingement cooling, where an increase in the speed of the cooling fluid results in an increase in heat transfer. Impingement cooling is often considered a better way of cooling a surface than convection cooling, but impingement cooling often consumes more air than does convection cooling, which reduces an operating efficiency of the gas turbine engine. However, in this configuration, the flow of cooling fluid 86 is performing convective cooling and, when directed in a manner that a component of its direction of travel is normal to the cone outer surface 80, it also provides some impingement cooling type benefits without the losses of traditionally associated with impingement cooling.

Complementing the directing region 110 of the flow sleeve inner surface 78 in the exemplary embodiment shown is a directing region 112 of the cone outer surface 80. After the flow of cooling fluid 86 impacts the landing 94 it encounters the directing region 112 of the cone outer surface 80, which directs the flow of cooling fluid 86 away from the cone outer surface 80, toward the directing region 110 of the flow sleeve inner surface 78, which then redirects the flow toward the landing 94. This process of directing and redirecting the flow of cooling fluid 86 thoroughly mixes the flow of cooling fluid 86 and provides impingement type cooling benefits, which is an improvement over the cooling typically provided by a smooth flow sleeve inner surface 78.

Having a flow sleeve inner surface 78 that is not smooth may increase a pressure drop along the cooling fluid path 84, but this can be accommodated for by other design parameters. For example, a distance between the cone outer surface 80 and the flow sleeve inner surface 78 can be increased to reduce the pressure drop, or decreased to increase the pressure drop. The distance may also be varied along the direction of the flow of cooling fluid 86. For example, the distance may be smaller proximate the cone downstream end 22 where the combustion gases 32 are traveling the fastest, and therefore where the most cooling is needed. Likewise, the distance may be the same proximate the cone upstream end 18 as at the cone downstream end 22, and this will result in a decrease in speed of the flow of cooling fluid 86 when the cooling fluid path 84 increases in diameter, because the volume will be greater at the cone upstream end 18 in such an embodiment. Alternately, the gap may be larger at the cone upstream end 18 to further reduce the speed of the flow of cooling fluid 86, and/or to account for an increase in a volume of the flow of cooling fluid 86 brought about by the addition of refresher cooling air along the length of the cooling fluid path 84. Other parameters that may be adjusted include a degree and amplitude of curve of the flow sleeve inner surface 78, and size and geometry of the raised geometric features 54 etc.

Refresher cooling air may be added through the flow sleeve 72 via refresher cooling holes 126 and these may be disposed anywhere along the cone longitudinal axis 56. If disposed proximate the cone upstream end 22 they may assist cooling by providing impingement cooling or simply further cooling fluid in the more narrow region of the cone 12, where the combustion gases 32 will be traveling the fastest, and therefore imparting the most heat to the cone inner surface 82. They may be disposed more toward the cone downstream end 18 to supply cooler refresher fluid to the flow of cooling fluid 86 which may have begun to increase in temperature. The refresher cooling holes 126 may be positioned so the cooling fluid flowing there through will cooperate aerodynamically with and/or to further mix the flow of cooling fluid 86 already flowing in the cooling fluid path 84. Further there may be one or more film cooling holes 128 disposed through the cone 12 as necessary.

Figure 3:
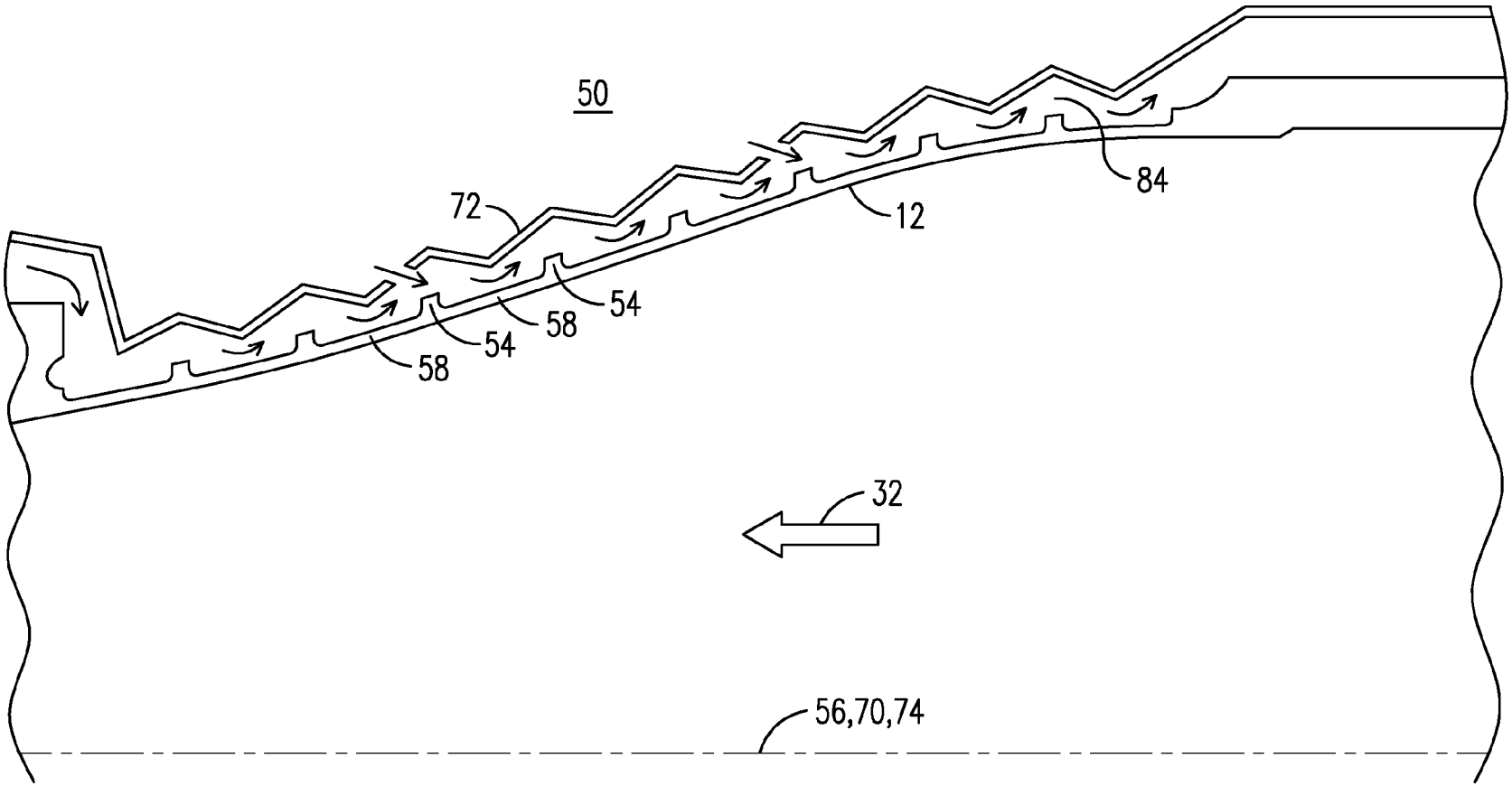
FIG. 3 shows a longitudinal cross section of an alternate exemplary embodiment of the flow sleeve.

FIG. 3 depicts an alternate exemplary embodiment where the flow sleeve 72, where the flow sleeve 72 has a rectilinear shape along the cone longitudinal axis 56. Shown are intersecting lines which form a zigzag type pattern, where the zigzag pattern also works in conjunction with the raised geometric features to form a serpentine shaped cooling fluid path 84. In yet another alternate exemplary embodiment the flow sleeve 72 might form a series of square shapes associated proximately axially with the raised geometric features 54.

It is contemplated that the raised geometric features 54 need not be limited to raised ribs, or even elongated features. For example, the raised geometric features 54 could be protrusions such as raised pedestals, or recessed features such as dimples, and the flow sleeve inner surface 78 may only undulate locally proximate the raised feature. Thus, there could be a flow sleeve inner surface 78 where in one location along the cone longitudinal axis 56, there may be an undulation in one circumferential location on the flow sleeve inner surface 78 and no undulation in a circumferential location adjacent thereto. For example, a checkerboard pattern of raised geometric features 54 may have a flow sleeve inner surface 78 with a checkerboard pattern of undulations.

The flow sleeve disclosed herein permits greater freedom in structural design of flow ducts used to conduct combustion gases from combustor cans to the first row of turbine blades. When used with ducts having raised geometric features, the flow sleeve enables cooling of these designs by improving mixing and creating impingement-like benefits without incurring impingement related costs. The flow sleeve does so while remaining relatively simple and can be installed by those familiar with existing cooling systems. Consequently, it represents an improvement in the art.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A ducting arrangement for a can annular gas turbine engine, comprising:

a duct disposed between a combustor and a first row of turbine blades and defining a hot gas path therein, the duct comprising raised geometric features incorporated into a duct outer surface;

a flow sleeve defining a cooling flow path between an inner surface of the flow sleeve and the duct outer surface; and a plurality of refresher cooling holes through the flow sleeve establishing fluid communication between a plenum surrounding the ducting arrangement and the cooling flow path;

wherein the flow sleeve is configured to direct a flow of cooling fluid in the cooling flow path in a direction against a direction of a flow of a hot gas flowing in the hot gas path;

wherein the raised geometric features comprise annular ribs oriented transverse to the direction of the flow of the cooling fluid in the cooling flow path, wherein after each time the flow of cooling fluid flows between the flow sleeve and a relatively upstream raised geometric feature, the inner surface of the flow sleeve deflects inward to direct the flow of cooling fluid toward a landing separating the relatively upstream raised geometric feature from a relatively downstream raised geometric feature, wherein the flow sleeve deflects outwards each time the flow sleeve is axially adjacent each of the raised geometric features, and wherein the inward and outward deflections repeat to form an undulation along a central axis of the hot gas path.

2. The ducting arrangement of claim 1, wherein with respect to the central axis of the hot gas path, the inner surface of the flow sleeve comprises a greater diameter when axially adjacent each relatively upstream raised geometric feature as compared to a diameter of the inner surface axially adjacent each landing separating each respective relatively upstream raised geometric feature from each relatively downstream raised geometric feature.

3. The ducting arrangement of claim 1, wherein the cooling flow path tapers outward in a direction opposite that of hot gas flowing in the hot gas path.

4. A ducting arrangement for a can annular gas turbine engine, comprising:

a duct wall disposed between a combustor and a first row of turbine blades and comprising: an inner surface defining a hot gas path and an outer surface opposite the inner surface, the outer surface of the duct wall comprising raised geometric features;

a flow sleeve surrounding the outer surface of the duct wall and defining a cooling flow path therebetween; and a refresher cooling hole through the flow sleeve;

wherein the cooling flow path is configured to guide a flow of cooling fluid between the raised geometric features and the flow sleeve and in a direction that is counter to a direction of hot gas flowing in the hot gas path;

wherein the raised geometric features protrude into the cooling flow path and comprise annular ribs oriented transverse to the direction of flow of the cooling fluid; and wherein with respect to a hot gas path central axis, a diameter of an inner surface of the flow sleeve repeatedly deflects inward and then outward to form an undulation along the hot gas path central axis, and with respect to the outer surface of the duct wall, the undulation is effective to impart an impingement vector toward the outer surface of the duct wall to the direction of flow of the cooling fluid in the cooling flow path after passing over a respective raised geometric feature, wherein with respect to the hot gas path central axis, the flow sleeve deflects outward each time the flow sleeve is axially adjacent to one of the raised geometric features and deflects inward each time the flow sleeve is axially between two adjacent raised geometric features; and wherein the refresher cooling hole is disposed in an outward deflecting portion of the undulation and is oriented to direct a flow of refresher cooling fluid toward a landing immediately following the outward deflecting portion.

5. The ducting arrangement of claim 4, wherein the undulation imparts the impingement vector to the direction of flow of the cooling fluid between all adjacent raised geometric features.

6. The ducting arrangement of claim 4, wherein for a decrease along the diameter of the outer surface of the duct wall in the direction of flow of the cooling fluid there exists a decrease in the diameter of the inner surface of the flow sleeve axially adjacent the decrease along the diameter of the outer surface of the duct wall.

7. The ducting arrangement of claim 4, wherein the inner surface of the flow sleeve comprises a corrugated curvilinear shape comprising undulations transverse to the hot gas path central axis.

8. A ducting arrangement for a can annular gas turbine engine, comprising:

a duct disposed between a combustor and a first row of turbine blades, defining a hot gas path therein, and comprising raised geometric features incorporated into an outer surface;

a flow sleeve defining a cooling flow path between an inner surface of the flow sleeve and the outer surface of the duct; and a refresher cooling hole through the flow sleeve;

wherein the cooling flow path is configured to guide a flow of cooling fluid between the raised geometric features and the flow sleeve and in a direction that is counter to a direction of hot gas flowing in the hot gas path;

wherein the raised geometric features comprise annular ribs oriented perpendicular to the direction of flow of the cooling fluid; and wherein with respect to a central axis of the hot gas path, the inner surface of the flow sleeve deflects inwards when axially adjacent each of a plurality of respective landings, each landing disposed between adjacent raised geometric features, and the inner surface of the flow sleeve deflects outwards when axially adjacent each of a plurality of the raised geometric features to form an undulation in the flow sleeve, and wherein with respect to the central axis of the hot gas path, the refresher cooling hole is disposed where the flow sleeve deflects outward over an axially adjacent and radially inward raised geometric feature of the plurality of raised geometric features, and wherein the refresher cooling hole aims toward a landing of the plurality of respective landings immediately downstream of the axially adjacent and radially inward raised geometric feature.

9. The ducting arrangement of claim 8, wherein the cooling flow path comprises a tapered shape that expands in an upstream direction of the central axis of the hot gas path.

10. The ducting arrangement of claim 8, wherein the inner surface of the flow sleeve comprises a curvilinear shape in a direction of the central axis of the hot gas path.

11. The ducting arrangement of claim 8, the flow sleeve further comprising a plurality of additional refresher cooling holes therethrough at a plurality of differing locations relative to the raised geometric features along the central axis of the hot gas path.

* * * * *